United States Patent [19]

Aldenhovel

[11] 4,125,773

[45] Nov. 14, 1978

[54] CONTROL SYSTEM FOR X-RAY APPARATUS

[75] Inventor: Hans Aldenhovel, Essen, Germany

[73] Assignee: Compagnie Generale de Radiologie, Paris, France

[21] Appl. No.: 779,199

[22] Filed: Mar. 18, 1977

[30] Foreign Application Priority Data

Mar. 20, 1976 [DE] Fed. Rep. of Germany ..... 2611911

[51] Int. Cl.[2] ..... H05G 1/30; H05G 1/46

[52] U.S. Cl. ..... 250/413; 250/401

[58] Field of Search ..... 250/413, 414, 415, 416 R, 250/401

[56] References Cited

U.S. PATENT DOCUMENTS 3,838,285 9/1974 Siedband et al. ..... 250/413

FOREIGN PATENT DOCUMENTS 2,351,694 4/1975 Fed. Rep. of Germany ..... 250/414

*Primary Examiner*—Alfred E. Smith
*Assistant Examiner*—T. N. Grigsby
*Attorney, Agent, or Firm*—Edwin E. Greigg

[57] ABSTRACT

A control system for an X-ray apparatus in which the selected values of tube voltage, tube current and exposure time are used to compute optimized values of the current-time product which is compared with stored values of permissible tube performance to produce tube settings and initiate tube cut-off. The transmission of control data is performed digitally while the computing is performed in an analog computer.

4 Claims, 1 Drawing Figure

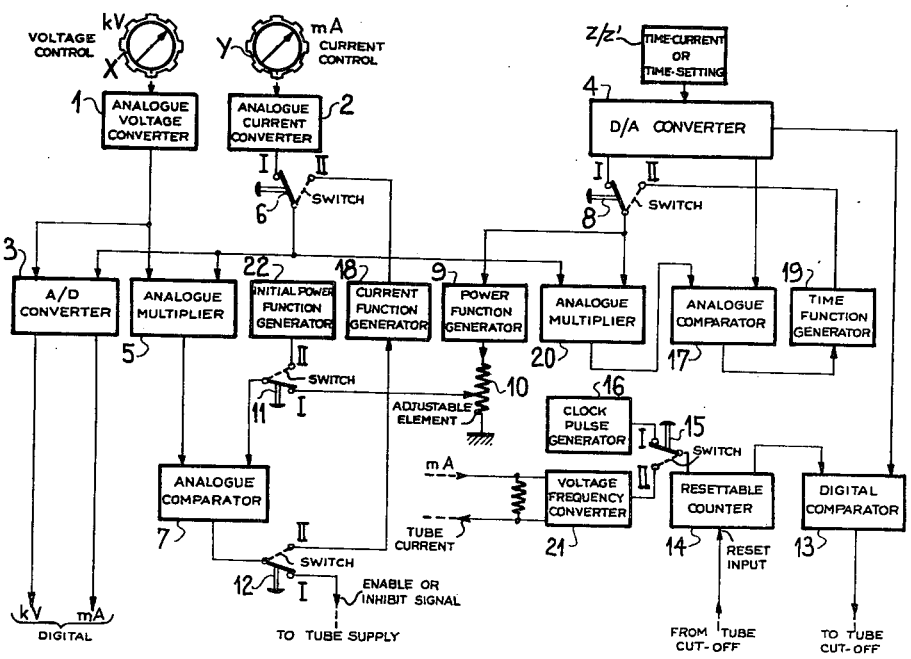

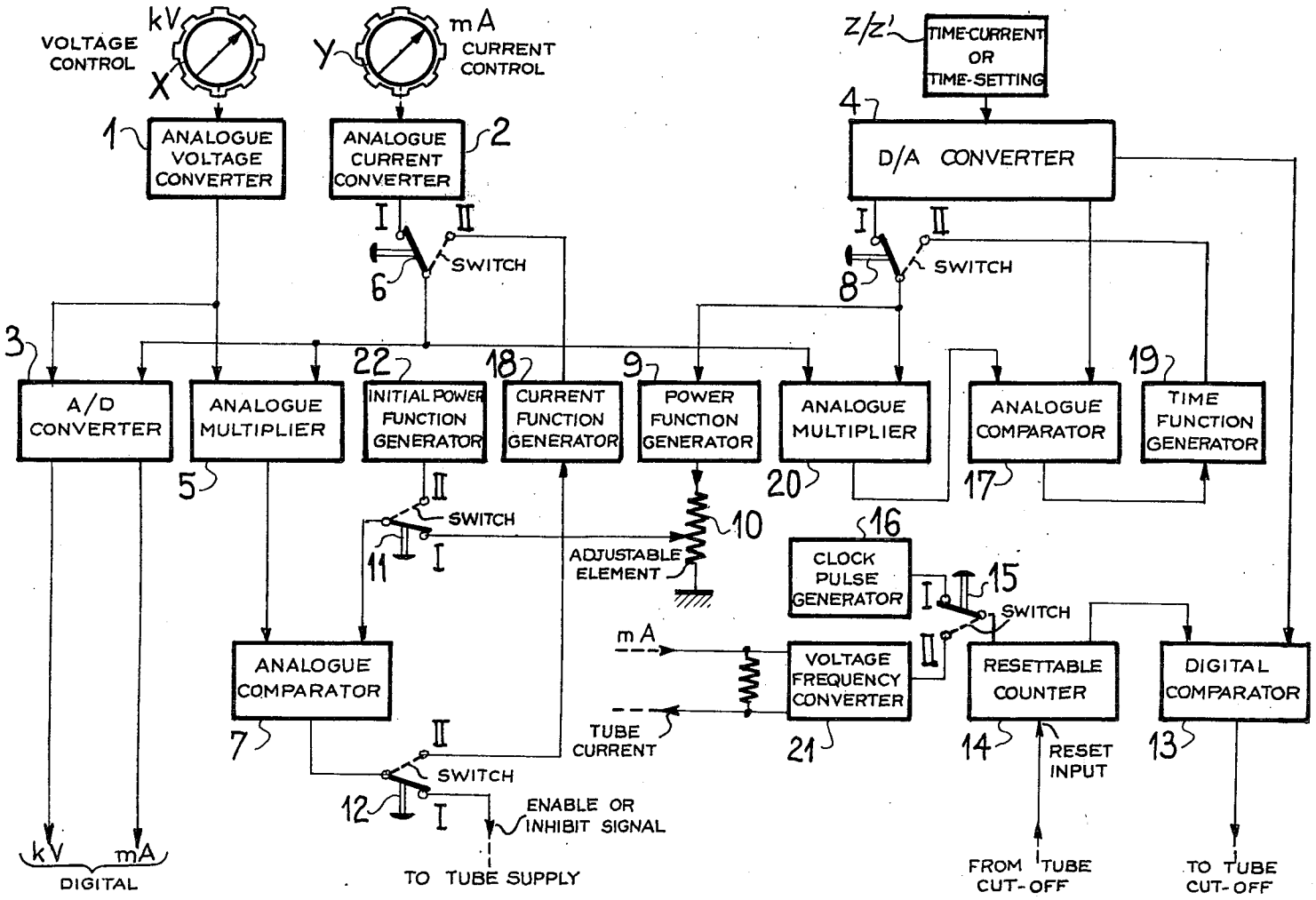
TIME-CURRENT OR TIME-SETTING
Z/Z'
D/A CONVERTER
4
SWITCH
8
TIME FUNCTION GENERATOR
19
ANALOGUE COMPARATOR
17
ANALOGUE MULTIPLIER
20
POWER FUNCTION GENERATOR
9
CURRENT FUNCTION GENERATOR
18
INITIAL POWER FUNCTION GENERATOR
22
ANALOGUE MULTIPLIER
5
A/D CONVERTER
3
DIGITAL COMPARATOR
13
TO TUBE CUT-OFF
RESETTABLE COUNTER
14
RESET INPUT
FROM TUBE CUT-OFF
SWITCH
15
CLOCK PULSE GENERATOR
16
VOLTAGE FREQUENCY CONVERTER
21
10
ADJUSTABLE ELEMENT
mA
TUBE CURRENT
ENABLE OR INHIBIT SIGNAL
TO TUBE SUPPLY
SWITCH
11
SWITCH
12
ANALOGUE COMPARATOR
7
mA CURRENT CONTROL
Y
ANALOGUE CURRENT CONVERTER
2
SWITCH
6
kV
X
VOLTAGE CONTROL
ANALOGUE VOLTAGE CONVERTER
1
mA
kV
DIGITAL

CONTROL SYSTEM FOR X-RAY APPARATUS

BACKGROUND OF THE INVENTION

The invention relates to an X-ray apparatus for medical diagnostic purposes including controlling means for adjusting the X-ray tube voltage, the exposure time and the tube current or the current-time product. The X-ray apparatus further includes a computer for calculating the mutual dependencies of the adjusted values with regard to maximum admissible power and optimum utilization of the X-ray tube.

It is generally known to adjust X-ray apparatus by means of knobs, etc. for the configuration which is desired for the particular examination. The required settings may also be introduced into the apparatus by means of a computer which uses technical or analog settings to check them with regard to the maximum permissible power of the X-ray tube and possibly with regard to a predetermined utilization factor of the tube and then employs further mechanical means for setting the chosen parameters at the appropriate elements of the machine in an analog fashion. The systems require a substantial mechanical expenditure and also a considerable and expensive degree of precision.

OBJECT AND SUMMARY OF THE INVENTION

It is a principal object of the present invention to provide an X-ray apparatus which is distinguished with respect to the known apparatus by a substantially simplified and entirely electrical configuration. It is a further object of the invention to provide an X-ray apparatus in which the input elements and the means for protecting the X-ray tube can be disposed in a separate location from the elements actually performing the adjustment.

These and other objects are attained, according to the invention, by providing that the input settings are converted by suitable means into electrical values and are then fed to control loops which are interdependent and which serve for processing either the tube voltage, the tube current and the time of exposure i.e. with three input settings, or the tube voltage and the current-time product, i.e. with two input settings. These control loops include function generators that have stored values of permissible power curves of the tube and which are used to compare the actual values with the set-point values. It is a further object of the invention to provide a computer which performs analog calculations but which transmits data to the final control elements in digital fashion.

A further feature of the invention is that the values related to X-ray tube voltage and X-ray tube current are adjusted in analog fashion, i.e., in stepless manner, whereas the values relating to the time or the current-time product are adjustable in digital, i.e., stepwise manner. The digitally set values of time or current time product are directly fed to final control elements which perform tube cutoff, whereas the analog values are fed to the computer.

A further development of the invention provides that in the so-called two and three point control methods, i.e. the setting of two or of three input parameters (kV, mAs or kV, mA, ms), the elements of the apparatus responsible for adjusting the current-time product and the time are combined and used together.

The invention further provides a clocking switch to operate as a counter for the preselected digital values of the current-time product used in the two point control method and also for the time values used in the three point control method.

The invention will be better understood as well as further objects and advantages thereof become more apparent from the ensuing detailed description of a preferred embodiment taken in conjunction with the accompanying drawing.

BRIEF DESCRIPTION OF THE DRAWING

The single FIGURE of the drawing is a block diagram indicating schematically the electrical connections within the control means of the X-ray apparatus of the invention.

DESCRIPTION OF THE PREFERRED EMBODIMENT

In the block diagram of the single FIGURE, the primary adjustment means X, Y, Z–Z', which may be rotary knobs, are used to set the most important data required for the use of the machine in X-ray examination. These data are for example the X-ray tube voltage (kV), the X-ray tube current (mA) or the current-time product (mAs) and the time (ms). The analog values of the tube voltage and the tube current settings are fed to two proportional converters 1 and 2, respectively, where they are transformed into proportional electrical values. Therefrom, they are fed firstly to a control loop for maximizing the X-ray current in the two point technology, which control loop will be explained in detail below, and also to an A/D converter 3 whence they are transmitted to the final control elements of the apparatus. Depending on the desired methodology, i.e., two or three point control or parameter setting method, the digital values of the current-time product or of the time are fed via a common line to elements which cause the shutoff of the apparatus and also to a D/A converter 4 which transmits analog equivalents thereof to a second control loop, to be explained below, in which the time of exposure is maximized in two point control technology. The transmission of data to the final control elements in digital form is especially advantageous for attaining a high degree of transmission precision which is especially important in the case of the parameter time which may vary in wide range.

In the so-called three point control, a first analog multiplying element 5 receives the electrical value proportional to the X-ray tube voltage directly and also receives a value proportional to the X-ray tube current via a switch 6 which, in three point control, is set in its position I. The signal then present at the output of the first multiplier 5 which corresponds to the actual value of the voltage-current product or power in kilowatts (kW), is fed to a first analog comparator 7. The other input of the first comparator 7 receives a signal which depends primarily on the adjusted value of the time and which is formed in the D/A converter 4 and fed via a second switch 8 to a first or power function generator 9 which processes this signal in respect to the permissible power output of the tube. As a matter of fact, this first function generator 9 delivers an electrical analog value corresponding to the maximum admissible power (in kW) as a function of the electrical analog value corresponding to the preset exposure time and available at one of the outputs of the digital-to-analog (D/A) converter 4 controlled by setting means Z'. The appropriate non-linear power vs.time function can be obtained, for example, by means of diode-type function generator as described on pages 251 to 253 of a book entitled "Operational Amplifiers" edited by GRAEME, TOBEY and HUELSMAN, published McGraw-Hill Book Co., New York. Connected behind the function generator 9 is an adjustable member 10 which permits varying the level of the signal delivered by the function generator 9 in dependence on the desired degree of utilization of the X-ray tube. Further connected between the adjustment member 10 and the comparator 7 is a third switch 11 which, in three point control, is located in the position I. The output of the first comparator 7 is a signal which is either a logical 1 or 0 and which is fed via a fourth switch 12 to a final control element which inhibits or enables the switching on of the X-ray tube i.e. the exposure, depending on whether the adjusted power is above or below the permissible power output of the tube.

In three point control, the X-ray exposure is terminated by taking the time adjusted at the element Z' and transmitting it in digital form to one input of a digital comparator 13, the other input of which is connected to a resettable counter 14 which is connected through a fifth switch 15 to a clocking pulse generator 16. If the comparator 13 finds that the signal delivered by the counter 14 on the basis of clocking or timing pulses received from the pulse generator 16 is equal to its other input datum, the comparator produces a shutoff signal fed to the X-ray tube supply control means (not shown).

In the so-called two point control method, the first analog multiplier 5 also receives the X-ray tube voltage directly. On the other hand, the first multiplier 5 also automatically receives the maximum admissible X-ray current corresponding to the adjusted or preset current-time product. This occurs because the adjusted current-time product set point value is fed to the input of a second analog comparator 17, the other input of which receives a signal corresponding to the momentary mismatch of the control loops based on informations from both a second function generator 18 associated with the tube current, and a third function generator 19 associated with the time, within a second analog multiplier 20 which generates the actual current-time product. The second or current function generator 18 includes, for example, an operational amplifier fed by the first analog comparator 7 through switch 12 in position II, which increases or decreases its analog output value (voltage) corresponding to the tube current until an equilibrium condition is obtained at the first comparator 7. The third or time function generator 19 includes, for example, another operational amplifier fed from a second analog comparator 17 which compares the analog values received, on the one hand, from the second multiplier 20 and, on the other hand, from the D/A converter 4 which delivers an analog voltage corresponding to time-current product set by digital adjusting means Z. This third function generator 19 increases or decreases its output voltage corresponding to the exposure time until the actual and set-point values of the current-time product (mAs) become equal. If a deviation exists, the second analog comparator 17 causes the third or time function generator 19 to reduce the time so that the generator 19 acts via the switch 8 which is now in position II on the function generator 9 which in turn acts through the switch 11 that remains in position I and on the comparator 7 in the sense of changing the permissible power, thereby increasing the X-ray tube current by means of the generator 18. This newly formed X-ray tube current value is fed to the multiplier 20 which produces a new actual value of the current-time product. If any deviation remains with respect to the set-point value of the current-time product, the time is further reduced and the X-ray current is further increased until the instant where the minimum time and maximum current obtained is consistent with the set current-time product set-point value, depending on the previously selected preferred power and utilization.

The apparatus is switched off by using the digital data related to the current-time product produced by the member Z and feeding them to the input of a digital comparator 13. The other input of the digital comparator 13 again receives the outputs of the counter 14 which is, in this case, connected to a voltage-to-frequency converter 21 via the switch 15 which now resides in position II. The voltage-to-frequency converter 21 receives a voltage which depends on the X-ray current (mA) and transforms it into a frequency proportional thereto. This pulse train is counted in the counter 14 and the result is transmitted to the comparator 13 which again produces a cutoff signal when the two input data are in agreement.

Finally, in the so-called one point control method, the input of the first analog multiplier 5 receives the analog value corresponding to the X-ray tube voltage as before, whereas its other input is connected to the second or current function generator 18 associated with the X-ray tube current via the switch 6 which is now in position II. A third function generator 22 delivers a signal corresponding to the initial power. This third function generator 22 may include a potentiometer fed by a d.c. voltage, which allows the setting of an analog value (voltage) corresponding to the initial power for a method for supplying power called the "decreasing load method" with a fixed exposure time preset to, for example, three seconds. This signal is fed via the switch 11, which is now in position II, to the first comparator 7. The output from the first comparator 7 is transmitted through the switch 12, which is now in position II, to the second generator 18. As a result, the control loop adjusts the maximum X-ray tube current associated with the X-ray tube voltage and this current is then reduced according to a nomogram related to the particular X-ray tube. The switch-off may take place by a timer mechanism, not shown.

The foregoing relates to preferred exemplary embodiments of the invention, it being understood that other embodiments and variants thereof are possible within the spirit and scope of the invention, the latter being defined by the appended claims.

What is claimed is:

1. In a control system for an X-ray apparatus which includes means for selecting the X-ray tube voltage, the time of exposure, the X-ray tube current and the current-time product, and further includes computer means for generating and storing optimum settings for the X-ray tube parameters based on predetermined values of X-ray tube performance, the improvement comprising:

converter means for changing the externally selected tube parameter values into electrical values related thereto;

a first control loop for receiving said electrical values related to tube voltage, tube current and the time of exposure, and for generating output signals to maintain the operation of the X-ray tube at said predetermined values, said first control loop being connected to said computer means to correct and terminate tube operation when the actual tube parameters depart from said optimum settings stored in said computer means;

a second control loop for receiving said electrical values related to tube voltage and the current time product, and for generating output signals to maintain the operation of the X-ray tube at said predetermined values, said second control loop being connected to said computer means to correct and terminate tube operation when the actual tube parameters depart from said optimum values stored in said computer means; and switch means for selective engagement of said first and second control loops; and wherein said output signals from said first and second control loops are digital signals.

2. A control system as defined by claim 1, wherein said means for selecting the X-ray tube voltage, the time of exposure, the X-ray tube current or the current-time product permits stepless adjustment of the X-ray tube voltage and the X-ray tube current and digital adjustment of the time or of the current-time product and wherein said apparatus further includes tube shutoff means actuated by said digital selected values of time and the current-time product and wherein said stepless values are transmitted to said computer means.

3. A control system as defined by claim 2, wherein for two and three point control, the means for selection of the current-time product values and for the time values as well as for the transmission of these values are combined and utilized together and wherein said tube shutoff means are partially combined and used together.

4. A control system as defined by claim 3, further comprising clocking means including a resettable counter for counting out a digital current-time product and a digital time value.

* * * * *